US007581670B2

(12) United States Patent
Erdie

(10) Patent No.: US 7,581,670 B2
(45) Date of Patent: Sep. 1, 2009

(54) SHIPPING CONTAINER

(75) Inventor: Jason S. Erdie, Richfield, OH (US)

(73) Assignee: Erdie End Caps, LLC, Lorain, OH (US)

( * ) Notice: Subject to any disclaimer, the term of this patent is extended or adjusted under 35 U.S.C. 154(b) by 747 days.

(21) Appl. No.: 11/079,739

(22) Filed: Mar. 14, 2005

(65) Prior Publication Data

US 2005/0205649 A1 Sep. 22, 2005

Related U.S. Application Data

(63) Continuation-in-part of application No. 10/801,786, filed on Mar. 16, 2004, now Pat. No. 7,296,730.

(51) Int. Cl.
*B65D 43/04* (2006.01)
*B65D 45/22* (2006.01)

(52) U.S. Cl. ..... 229/5.5; 220/326; 220/345.3; 229/125.17

(58) Field of Classification Search ..... 229/125.17, 229/5.5; 220/324, 326, 345.2, 345.3
See application file for complete search history.

(56) References Cited

U.S. PATENT DOCUMENTS 2,504,850 A 4/1950 Lermer
2,777,630 A 1/1957 Moberger
2,969,160 A 1/1961 Delk, Jr.
3,161,345 A 12/1964 McLeod
3,599,821 A 8/1971 Eggert et al.
3,899,117 A * 8/1975 Peyser et al. ..... 229/5.5
3,913,774 A 10/1975 Vajtay
3,986,659 A 10/1976 Vajtay
4,196,818 A 4/1980 Brownbill
4,301,640 A 11/1981 Haas
4,520,921 A * 6/1985 Vissing ..... 220/326
4,801,039 A 1/1989 McCall et al.
4,811,857 A 3/1989 Thompson
4,886,947 A 12/1989 Thompson
5,435,455 A 7/1995 Pruss
5,699,959 A 12/1997 Huspeka et al.
5,839,260 A 11/1998 Brody (Continued)

OTHER PUBLICATIONS

Almco Group, Inc., undated screen capture image from web page "http://www.amclo.com/" showing exemplary plastic end caps for paper tubes.

(Continued)

*Primary Examiner*—Gary E Elkins
(74) *Attorney, Agent, or Firm*—Rankin, Hill & Clark LLP

(57) ABSTRACT

The present invention provides a shipping container, a paper tube, an end cap and a method. The shipping container includes a tube and an end cap. The tube has a cylindrical body and an open end. The cylindrical body has a mounting opening formed therein adjacent to the open end. The end cap includes a circular sidewall that is adapted to be received by the open end of the tube such that either the circular sidewall is surrounded by the cylindrical body or the cylindrical body is radially surrounded by the circular sidewall. The circular sidewall includes a projection that extends away from the circular sidewall and into the mounting opening so as to releasably secure the end cap to the tube.

24 Claims, 7 Drawing Sheets

U.S. PATENT DOCUMENTS

| | | | | |
|---|---|---|---|---|
| 6,276,528 | B1 | 8/2001 | Nowotny et al. | |
| 6,401,952 | B1 | 6/2002 | Ming | |
| 6,792,977 | B2 | 9/2004 | Presby | |
| 7,296,729 | B2 * | 11/2007 | Erdie | 229/125.17 |
| 2004/0040959 | A1 | 3/2004 | Menceles | |
| 2005/0161463 | A1 | 7/2005 | Litchman | |

OTHER PUBLICATIONS

Atom Marketing, Inc., undated screen capture image from web page "http://www.plasticendplugs.com/" showing exemplary plastic end caps for paper tubes.

Custom Paper Tubes, Inc., undated screen capture image from web page of "http:/www.custiompapertubes.com/closur.shtml" showing exemplary plastic end caps for paper tubes.

Western Container Corporation, undated screen capture image from web page http://www.thomasregister.com/olc/smartcat_aspx?az=70281001&type=details?ptno=P-1506K&TEMPLATE=/olc/70281001/template.htm&iheight=150&fontsize=2&stripecolor=cccccc&tablewidth=430&bordercolor=333300&BGCOLOR-ffffff showing exemplary plastic end caps for paper tube.

Color Photographs of "LCR Dice Game" sold by George and Company of Buffalo, New York; 1992.

* cited by examiner

FIG. 1
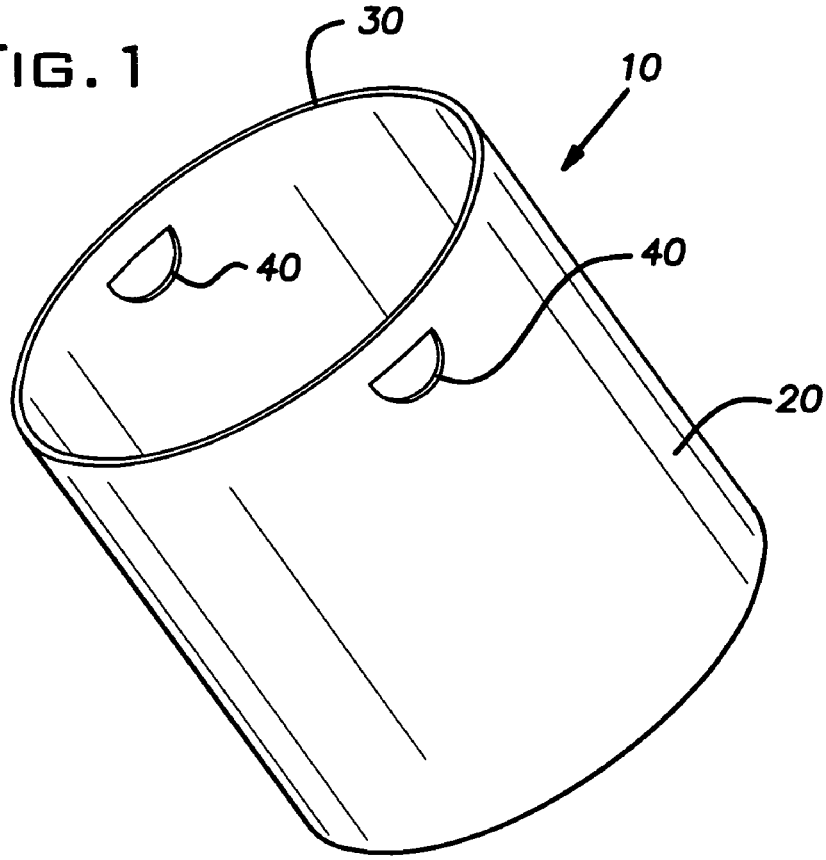
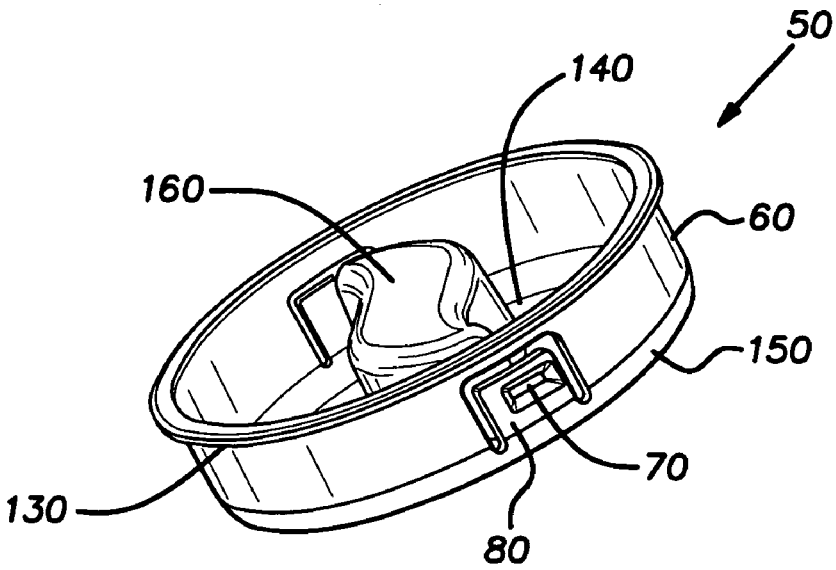
FIG. 2

FIG. 5
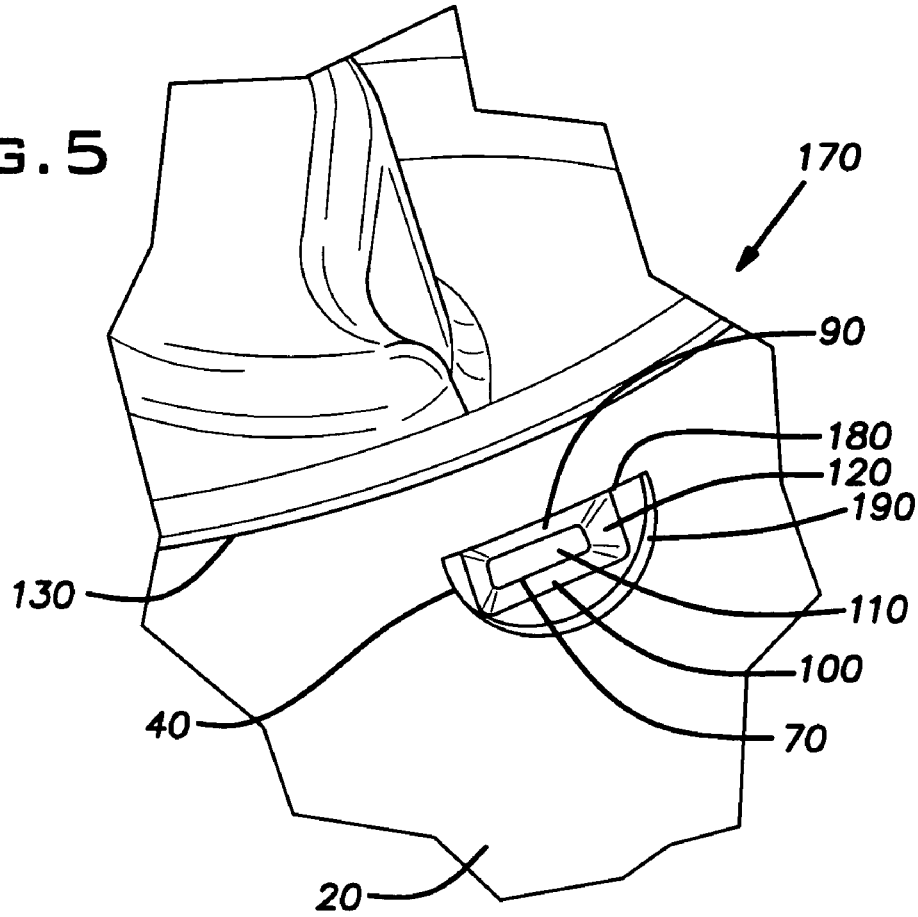
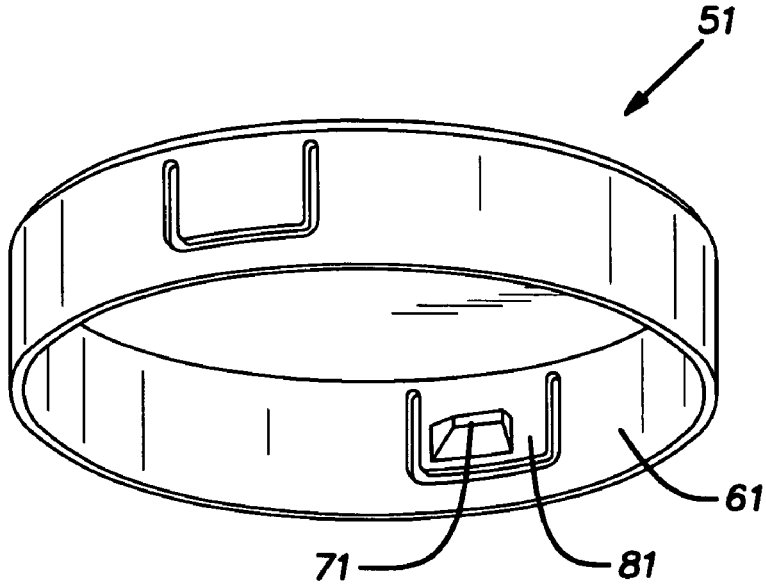
FIG. 6

FIG. 7
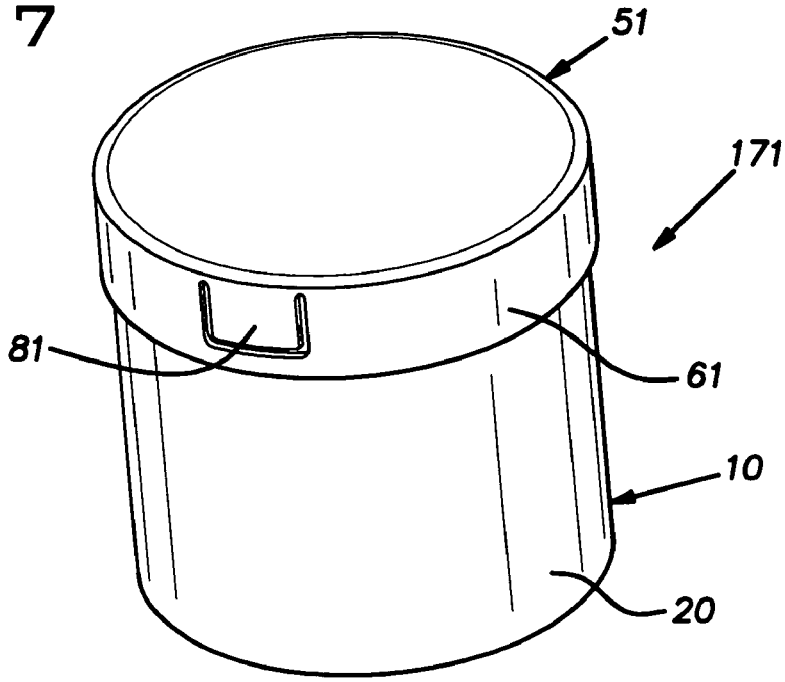
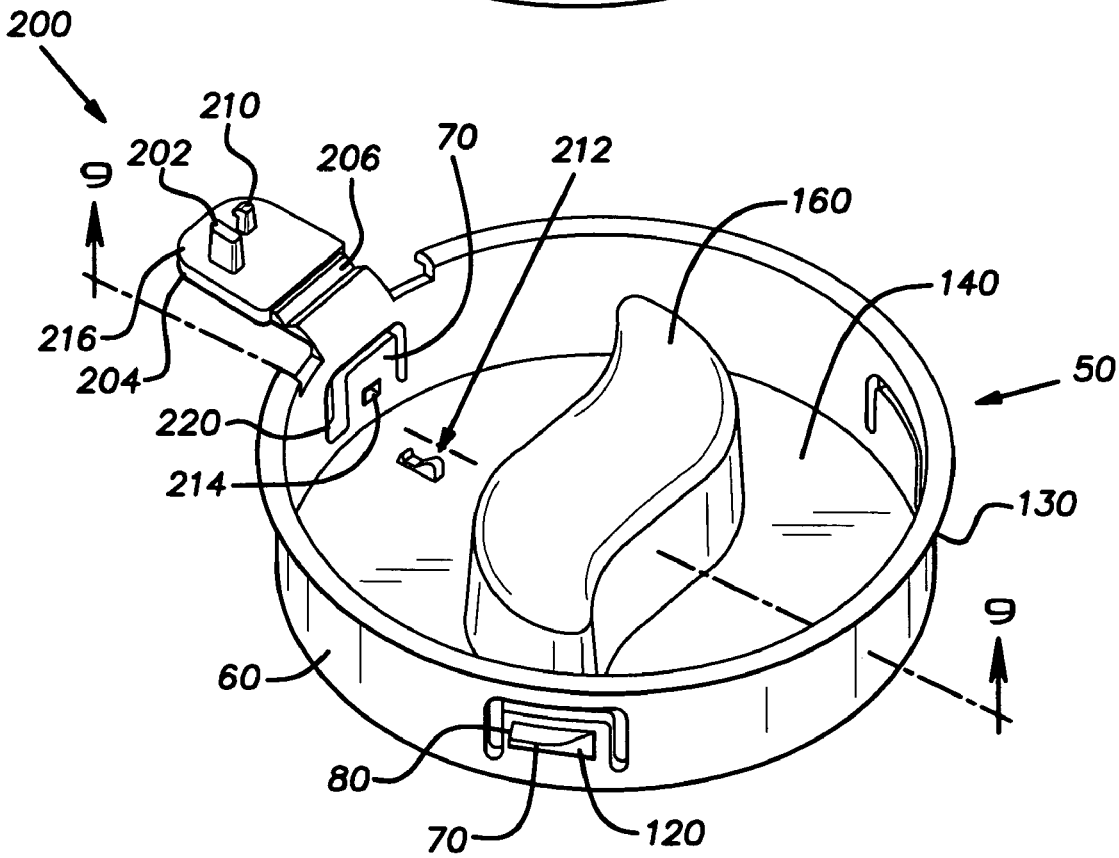
FIG. 8

SHIPPING CONTAINER

CROSS REFERENCE TO RELATED APPLICATIONS

The present application is a continuation-in-part of U.S. Ser. No. 10/801,786, filed Mar. 16, 2004, the disclosure of which is hereby incorporated by reference.

BACKGROUND OF THE INVENTION

1. Field of Invention

The present invention relates to shipping containers and, more particularly, to shipping containers comprising a tube and an end cap that is releasably secured to the tube.

2. Description of Related Art

Paper tubes are conventionally formed by adhesively bonding two or more continuous strips of paper to each other in overlapping layers around a cylindrical mandrel and then cutting the paper cylinder or tube thus formed to desired length. The open ends of the paper tube can then be closed using end closures to form a shipping container that is both light in weight and strong. Shipping containers of this type are often used to ship large-format papers or photos, which can be rolled and stored inside the tube. Shipping containers of this type are provide more protection to contents stored within the tube and are easier to handle than oversized envelopes.

A variety of end closures are known in the art for closing the open end of a paper tube. A very popular type is known in the industry as a plastic end cap or plug. Conventional plastic plugs include a bottom wall having a substantially circular peripheral edge and a sidewall that extends from the peripheral edge. In most cases, the plastic plug further comprises an annular flange that extends from the sidewall. The outer diameter of the flange is typically larger than the inner diameter of the paper tube and thus the flange acts as a stop or limiting rim that prohibits the plug from being pressed completely into the paper tube. The plug is retained in the end of the paper tube by a friction fit between outer surface of the sidewall and the inner surface of the paper tube. One or more ribs or ridges are sometimes formed on the outer surface of the sidewall to improve contact between the outer surface of the sidewall and the inner surface of the paper tube.

Plastic plugs are relatively simple to manufacture, inexpensive and lightweight. In addition, they can easily be inserted into and removed from an open end of a paper tube by hand. These features make plastic plugs particularly suitable for use forming mailing tubes or other similar shipping containers.

There are some drawbacks with the use of plastic plugs, however. Plastic plugs can sometimes "pop" out of one or both ends of the paper tube, which then allows the contents of the container to spill out. The plugs can "pop" out when the paper tube is squeezed or when the contents of the container shift during transit and strike the interior side of the bottom wall causing it to become dislodged from the paper tube.

Adhesive tape is sometimes applied over the plastic plug in an effort to insure that the plastic plug remains in the tube. Alternatively, staples are sometimes used to secure the plastic plug to the paper tube. Both of these solutions are disadvantageous because they require additional time consuming steps or procedures. Moreover, use of adhesive or staples can damage the tube and/or end cap, which prevents reuse.

SUMMARY OF THE INVENTION

The present invention provides a shipping container comprising a tube and an end cap. The tube has a cylindrical body and an open end. At least one or, more preferably, a plurality of mounting openings are formed in the cylindrical body of the tube adjacent to the open end. The end cap comprising a circular sidewall that is adapted to be received by the open end of the tube. In a first embodiment of the invention, the circular sidewall is radially surrounded by the cylindrical body. In a second embodiment of the invention, the cylindrical body is radially surrounded by the circular sidewall. In both embodiments, the circular sidewall includes a projection that extends away from the circular sidewall and into the mounting opening so as to releasably secure the end cap to the tube.

Preferably, each projection is formed on a deflectable tab portion of the circular sidewall. Each projection preferably comprises a top edge portion that is arranged to contact against a top peripheral portion of the mounting opening, which prevents withdrawal of the end cap from the tube. Each projection also preferably comprises a bottom ramp portion that is arranged opposite the top edge portion for promoting deflection of the deflectable tab when the end cap is received by the open end of the tube, and a side ramp portion that is arranged between the top edge portion and the bottom ramp portion to promote deflection of the deflectable tab when the end cap is rotated relative to the tube at a time when the projection extends into the mounting opening. The end cap preferably further comprises an end wall that extends between the circular sidewall. The end wall can further comprise a handle portion for facilitating rotation of the end cap relative to the tube.

In the first embodiment of the invention, the end cap is pressed into the open end of the tube, which causes the cylindrical body of the tube to radially surround the circular sidewall of the end cap. As the end cap is being pressed into and received by the open end of the tube, the bottom ramp of the projection contacts the cylindrical body of the tube at the perimeter of the open end which causes the deflectable tab to be deflected inwardly. If the projection is aligned with the corresponding mounting opening, the spring force provided by the deflectable tab causes the tab to spring back and extend the projection into the mounting opening. If the projection is not aligned with the corresponding mounting opening, the end cap can be rotated relative to the tube to align the projection with the mounting opening.

The end cap can be selectively released from the tube simply by rotating the end cap relative to the tube. The side ramp portion of the projection causes the deflectable tab to be deflected inwardly until the top edge portion of the projection is no longer aligned with and thus cannot contact the top peripheral portion of the mounting opening. After rotation, the end cap can simply be withdrawn from the tube by pulling the end cap from the tube. The handle portion of the end wall facilitates both rotation and removal of the end cap from the tube.

For security purposes, a lock member is formed integrally with the circular sidewall of the end cap. The lock member secures the projection so that it cannot be removed in from the mounting opening in normal operation. The lock member comprises a protruding portion for contacting the mounting opening to inhibit releasable engagement of the end cap from the mounting opening.

The shipping container according to the invention is light in weight and very strong. The end cap can be releasably secured to the tube to close off the open end without the need for special tools. Furthermore, the end cap is very difficult to accidentally or unintentionally dislodge from the tube. However, it can be easily removed by hand and reused. No fasteners or adhesives of any type need be used to keep the end cap secured to the tube.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

BRIEF DESCRIPTION OF THE DRAWINGS

FIG. 1 is a perspective view of a paper tube according to the present invention.

FIG. 2 is a perspective view of a first embodiment of an end cap according to the present invention.

FIG. 5 is a detailed perspective view of a portion of the shipping container shown in FIG. 4.

FIG. 6 is a perspective view of a second embodiment of an end cap according to the present invention.

FIG. 7 is a perspective view of a second embodiment of a shipping container according to the invention.

FIG. 8 is a perspective view of a preferred embodiment of an end cap including a locking member according to the present invention.

DETAILED DESCRIPTION OF THE PREFERRED EMBODIMENTS

Figure 3:
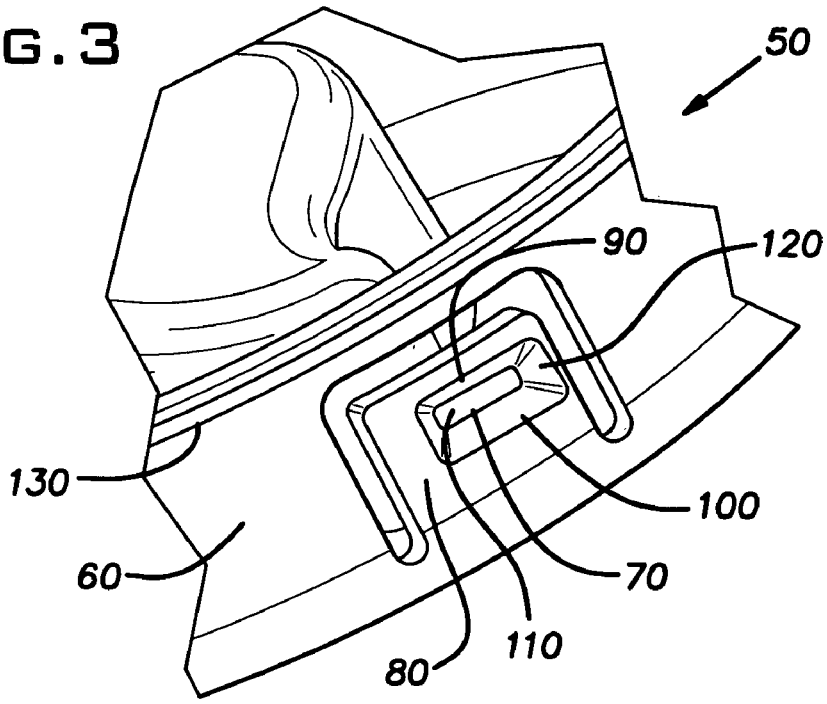
FIG. 3 is a detailed perspective view of a portion of the end cap shown in FIG. 2.

A perspective view of a paper tube 10 according to the invention is shown in FIG. 1. The paper tube 10 comprises a cylindrical body 20 having at least one open end 30. At least one or, more preferably, a plurality of mounting opening 40 are formed in the cylindrical body 20 adjacent to the open end 30. Preferably, a plurality of mounting openings 40 are spaced an equal distance apart radially about the cylindrical body 20 adjacent to the open end 30.

The paper tube 10 can be of any size. Paper tubes 10 having an inner diameter of from about two inches to about four inches are preferably provided with either two, three or four mounting openings 40 formed in the cylindrical body 20 adjacent to the open end. Paper tubes having an inner diameter of greater than about four inches to about seven inches are preferably provided with five, six, seven, eight or more mounting openings 40.

The wall thickness of the cylindrical body 20 is preferably within the range of from about 0.050 inches to about 0.250 inches, with wall thicknesses of 0.070 inches to about 0.125 inches being most preferred. The cylindrical body can be of any desired length. The paper tube can be formed using conventional paper tube manufacturing techniques. The mounting holes 40 can be formed by cutting, punching or by other forming means.

A perspective view of an exemplary end cap 50 according to a first embodiment of the invention is shown in FIG. 2. In the first embodiment of the invention, the end cap 50 comprises a circular sidewall 60 and at least one or, more preferably, a plurality of projections 70 that extend or project outwardly away from the circular sidewall 60.

With reference to FIG. 3, which shows a detailed perspective view of a portion of the end cap 50 shown in FIG. 2, each projection 70 is preferably formed on a deflectable tab portion 80 of the circular sidewall 60. The shape and orientation of the deflectable tab portion 80 is not critical, and a variety of shapes or configurations can be used. However, the deflectable tab portion 80 should be sized and configured to facilitate sufficient inward deflection of the tab portion 80 that a top edge portion 90 of the projection 70 does not extend beyond the circular sidewall 60 of the end cap 50 (or a cylinder defined by the circular sidewall 60). This is necessary in order to facilitate removal of the end cap 50 from the paper tube 10.

As is shown in FIG. 3, the projection 70 also preferably comprises a bottom ramp portion 100 arranged on a side opposite the top edge portion 90. The bottom ramp portion 100 preferably provides a gradual or angled approach from the circular sidewall 60 (or the cylinder defined thereby) to a tip 110 or farthest point of the projection 70. The bottom ramp portion 100 promotes inward deflection of the deflectable tab portion 80 when the end cap 50 is pressed into the open end 30 of the tube 10.

The projection 70 also preferably comprises a side ramp portion 120 that is arranged on either or both sides of the projection 70 between the top edge portion 90 and the bottom ramp portion 100. Like the bottom ramp portion 100, the side ramp portion 120 provides a gradual or angled approach from the circular sidewall 60 (or the cylinder defined thereby) to a tip 110 or farthest point of the projection 70.

It will be appreciated that the shape of the projection 70 is not per se critical, and that rounded "bumps" with a generally flat top edge portion 90 or other shapes could be used. It will also be appreciated that the deflectable tab portion 80 and the projection 70 can be coextensive. It is important, however, that the top edge portion 90 of the projection 70 be able to contact the top peripheral edge 180 (see FIG. 5) of the mounting opening 40 to prevent the removal of the end cap 50 from the tube 10, and that the projection 70 be able to be positioned (by rotation) such that it no longer projects into the mounting opening 40.

The end cap 50 also preferably comprises a peripheral rim portion 130 that extends beyond the circular sidewall 60 and an end wall 140 that extends between the circular sidewall 60. The end wall 140 can extend between the circular sidewall 60 at any point (i.e., at the bottom or at the top or at any point in between). In FIG. 2, the end wall 140 extends from a lower or bottom portion 150 of the circular sidewall 60. Preferably, the end wall 140 further comprises a handle portion 160 for facilitating rotation of the end cap 50 relative to the tube 10.

The shape and configuration of the handle portion 160 is not critical, but should provide a comfortable gripping surface for one's fingers.

The end cap is preferably formed of a plastic material such as polystyrene, polyethylene, polypropylene, nylon and/or one or more other thermoplastic or thermosetting polymers. The end cap can be formed using conventional molding or fabricating processes and equipment.

Figure 4:
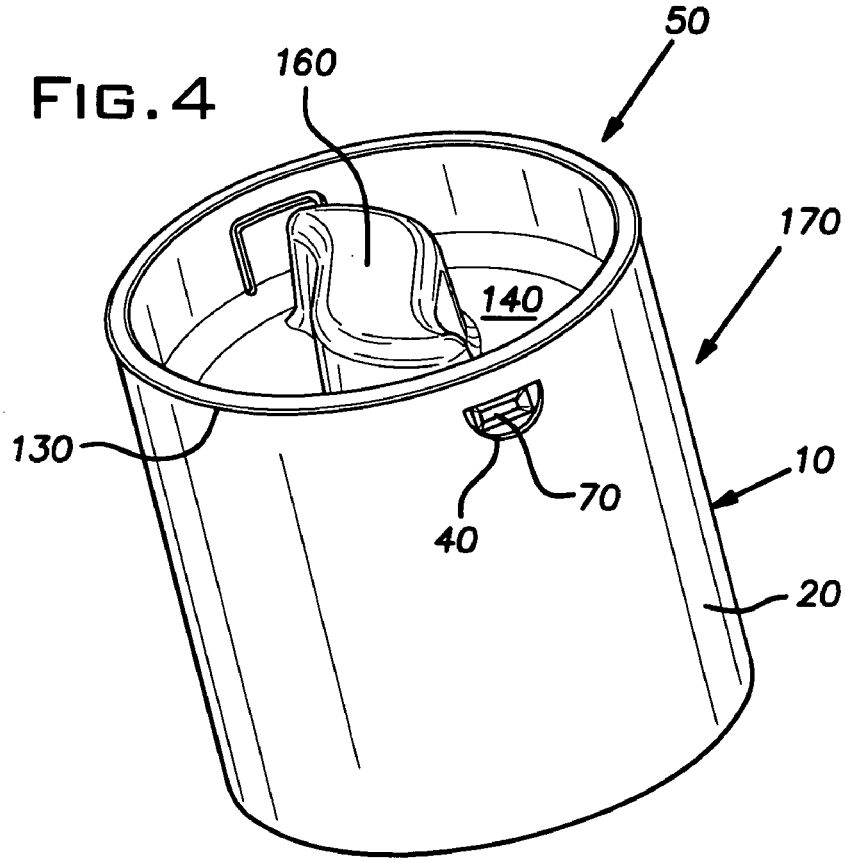
FIG. 4 is a perspective view of a first embodiment of a shipping container according to the invention.

FIG. 4 shows a perspective view of an exemplary shipping container 170 that can be formed by joining a tube 10 and an end cap 50 according to a first embodiment of the invention together. As shown in FIG. 4., the end cap 50 closes or seals off the open end 30 of the tube 10. The end cap 50 is received within the open end 30 of the tube 10 such that the cylindrical body 20 radially surrounds the circular sidewall 60. At least one projection 70 extends away from the circular sidewall 60 and into a corresponding mounting opening 40 so as to releasably secure the end cap 50 to the tube 10.

With reference to FIG. 5, which shows a detailed perspective view of a portion of the shipping container 170 shown in FIG. 4, the top edge portion 90 of the projection 70 is arranged to contact against a top peripheral portion 180 of the mounting opening 40 to thereby prevent withdrawal of the end cap 50 from the tube 10. Rotation of the end cap 50 relative to the tube 10, however, causes the side ramp portion 120 to contact a side peripheral portion 190 of the mounting opening 40, which causes inward deflection of the deflectable tab portion 80 sufficient to prevent engagement or contact between the top edge portion 90 and the top peripheral portion 180 of the mounting opening 40. Once the projection 70 is no longer aligned with and extending into the mounting opening 40, the end cap 50 can simply be withdrawn or pulled from the open end 30 of the tube 10.

FIG. 6 shows an exemplary end cap 51 in accordance with a second embodiment of the invention. The end cap 51 according to the second embodiment of the invention is substantially similar to the end cap 50 according to the first embodiment of the invention, except that it is configured to radially surround the cylindrical body 20 of the tube 10 rather than be radially surrounded thereby. Accordingly, the end cap 51 comprises a circular sidewall 61 and one or, more preferably, a plurality of projections 71. The projections 71 extend inwardly away from the circular sidewall 61. Preferably, the projections 71 are formed on deflectable tab portions 81 of the circular sidewall 61. The projections preferably include a top edge portion, a bottom ramp portion, and at least one side ramp portion.

FIG. 7 shows a perspective view of an exemplary shipping container 171 according to a second embodiment of the invention. The shipping container 171 includes an end cap 51 having a circular sidewall 61 that radially surrounds a cylindrical body 20 of a tube 10 adjacent to an open end. Projections 71 extending inwardly away from the circular sidewall 61 extend into the mounting openings 40 formed in the cylindrical body 20 of the tube adjacent to the open end and thereby prevent the unintentional removal of the end cap 51 from the tube 10.

No handle portion need be provided on the end cap 51. A user simply grips the circular sidewall 61 and twists or rotates it relative to the tube 10. The side ramp (not shown) contacts the side peripheral portion of the mounting opening and thereby deflects the deflectable tab portion of the end cap outwardly until the top edge portion of the projection 71 is not longer aligned with and extending into the mounting opening or in contact with the top peripheral portion of the mounting opening. The end cap 51 can thereafter be withdrawn or pulled away from the tube 10.

Thus, the present invention provides methods of releasably securing an end cap to a tube. A first embodiment of a method of the invention comprises: (1) providing a tube comprising a cylindrical body having at least one open end and a plurality of mounting openings formed therein adjacent to the open end; (2) providing an end cap comprising a circular sidewall having a plurality of projections that extend away from the circular sidewall, each projection being formed on a deflectable tab portion of the circular sidewall; and (3) pressing the end cap into the open end of the tube until the cylindrical body surrounds the circular sidewall and the plurality of projections extend into the plurality of mounting openings to releasably secure the end cap to the tube. Material to be shipped can be placed within the tube before the end cap is secured thereto. In addition, shrink film or paper strips can be applied over the end cap to provide a tamper resistant or tamper evident container. The method preferably further comprises: (4) rotating the end cap relative to the tube until the projection is not received within the mounting opening; and (5) pulling the end cap from the tube.

A second embodiment of a method of the invention comprises: (1) providing a tube comprising a cylindrical body having at least one open end and a plurality of mounting openings formed therein adjacent to the open end; (2) providing an end cap comprising a circular sidewall having a plurality of projections that extend away from the circular sidewall, each projection being formed on a deflectable tab portion of the circular sidewall; and (3) pressing the end cap into the open end of the tube until the circular sidewall surrounds the cylindrical body and the plurality of projections extend into the plurality of mounting openings to releasably secure the end cap to the tube. Material to be shipped can be placed within the tube before the end cap is secured thereto. In addition, shrink film or paper strips can be applied over the end cap to provide a tamper resistant or tamper evident container. The method preferably further comprises: (4) rotating the end cap relative to the tube until the projection is not received within the mounting opening; and (5) pulling the end cap from the tube.

The present invention is particularly useful for forming reusable shipping containers. The end caps can be securely attached to the paper tubes quickly and without the need for special tooling, and can be removed with relative ease. The end caps of shipping tubes formed in accordance with the invention are significantly more difficult to unintentionally dislodge from an open end of a paper tube than conventional plastic plugs or other end closures.

In a preferred embodiment of the present invention, as shown in FIG. 8, the end cap 50 is again a component of a shipping container that cooperates with a tube comprising a cylindrical body and an open end, such that the cylindrical body includes a mounting opening formed therein adjacent to the open end, as indicated hereinabove. The end cap 50 engages the open end of the tube, for enclosing the open end. The end cap 50 includes a circular sidewall 60 adapted to be in an abutting arrangement with a portion of the cylindrical body of the tube, adjacent to the open end of the tube.

In one aspect of the invention, it is appreciated that one of the circular sidewall 60 and the cylindrical body of the tube is radially surrounded by the other of the circular sidewall 60 and the cylindrical body. For example, it is contemplated that, for the subsequently disclosed embodiments, the circular sidewall 60 could be configured to surround the cylindrical body of the tube, as is shown with the embodiment of FIG. 7. However, it is preferred that the circular sidewall 60 of the end cap 50 is adapted to be received within the open end of the tube such that the circular sidewall 60 is radially surrounded by the cylindrical body of the tube, as would follow from the embodiment depicted in FIGS. 8-15.

In the preferred embodiment, a projection 70 is formed into the circular sidewall 60. The projection 70 extends away from the circular sidewall 60 and releasably engages the mounting opening formed on the tube so as to secure the end cap 50 to the tube.

As especially shown in FIGS. 8-12, the preferred embodiment includes a lock member 200, which creates a tamper-evident seal for insuring the security of the contents of the shipping container during transport. The lock member 200 is formed integrally with the circular sidewall 60, and secures the projection 70 so that it cannot be removed in from the mounting opening in normal operation. The lock member 200 comprises a protruding portion 202 for extending through the mounting opening 40 when the end cap is mounted in the paper tube. The protruding portion 202 contacts the side peripheral portion 190 of the mounting opening 40, so as to inhibit releasable engagement of the end cap 50 from the mounting opening 40, as will be explained in greater detail hereinbelow.

As indicated in the above embodiments, the present projection 70 includes a deflectable tab portion 80, extending within a cavity in the circular sidewall 60, upon which the projection 70 is formed. A side ramp portion 120 is preferably a beveled edge formed on the projection 70 and promotes inward deflection of the deflectable tab portion 80 when the end cap 50 is rotated relative to the tube, in an instance where the projection 70 is extending into the mounting opening of the tube. In this way, the side ramp portion 120 enables the release of the end cap 50 from the open end of the tube. As is especially shown in FIG. 11, when the lock member 200 is engaged, the protruding portion 202 of the lock member 200 is configured to obstruct the side ramp portion 120. Upon rotation of the end cap 50 relative to the tube, the protruding portion 202 thereby prevents the side ramp portion 120 from engaging the side peripheral portion 190 of the mounting opening 40, and thus prevents the inward deflection of the deflectable tab 80. In this way, the protruding portion 202 inhibits releasable engagement of the projection 70 from the mounting opening.

A detailed exposition follows of the elements and operation of the present lock member 200. The lock member 200 includes a lock portion 204, which is preferably a generally flat tab. A hinge 206 is preferably formed integrally with the lock portion 204 for pivotally connecting the lock portion 204 to the sidewall 60 of the end cap 50. In the preferred embodiment, the hinge 206 is a living hinge, i.e. a portion of tapered thickness formed adjacent to the lock portion 204, so as to be a flexible region for pivotal motion. The protruding member 202 is formed onto the lock portion 204 so as to extend from the surface of the lock portion 204, preferably in a perpendicular direction. The lock member 200 can also include a locking hook 210, also preferably formed on the lock portion 204, and a locking tab 212, formed on the end wall 140 of the end cap 50.

Figure 9:
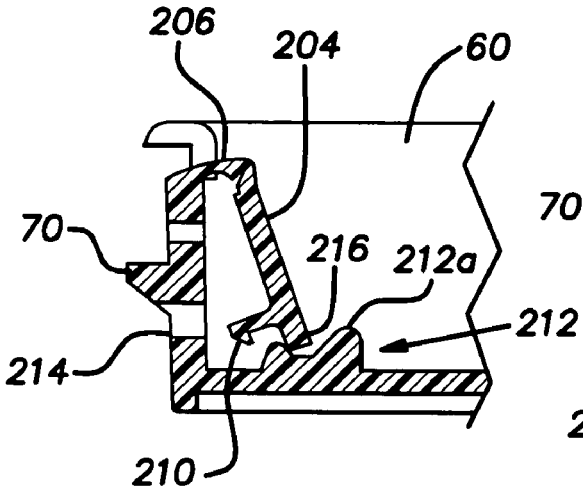
FIG. 9 is a side-sectional view of the preferred embodiment of an end cap along the line 9-9 of FIG. 8 showing the insertion of the locking member according to the present invention.
Figure 10:
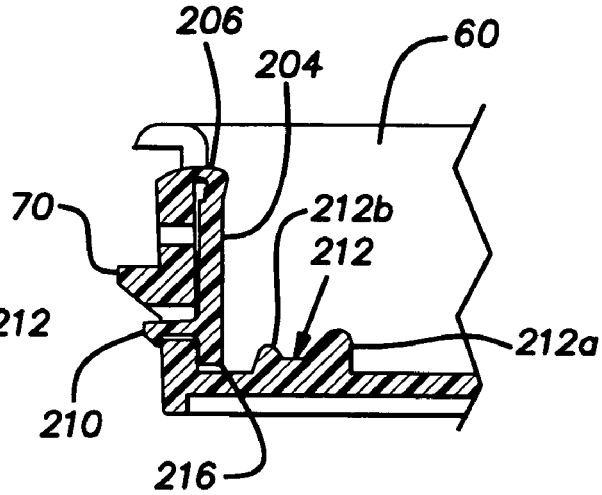
FIG. 10 is a side-sectional view of the preferred embodiment of an end cap of FIG. 9 showing the engagement of the locking member according to the present invention.
Figure 11:
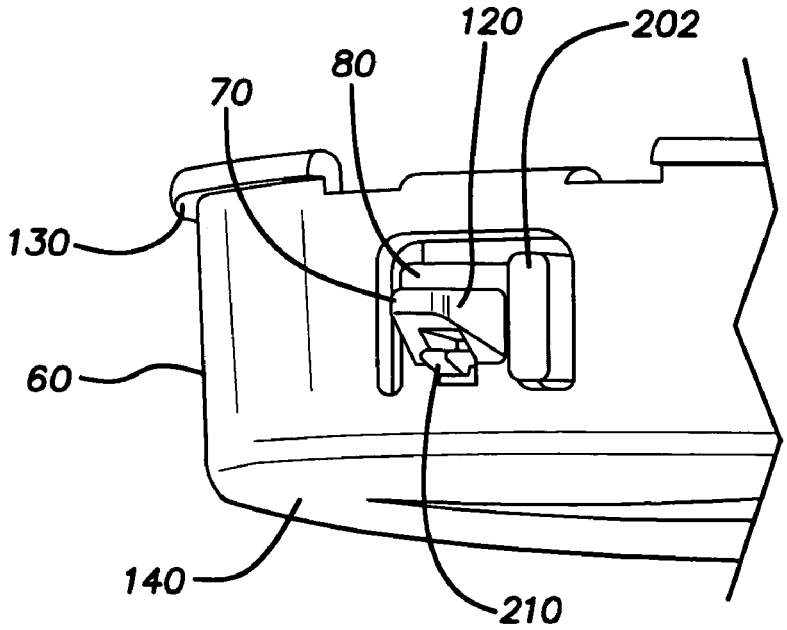
FIG. 11 is a perspective view of the preferred embodiment of an end cap showing the engagement of the locking member according to the present invention.

In operation, as especially shown in FIGS. 9 and 10, which are side sectional views of the cap shown in FIG. 8 along the line 9-9, the hinge 206 pivotally swings the lock portion 204 into engagement with the projection 70. The locking hook 210 engages and is retained within a projection aperture 214 formed in the projection 70. The locking tab 212 engages and retains an edge 216 of the locking member 200. As the lock portion 204 is swung into engagement with the projection 70, the protruding portion 202 is swung into engagement with a sidewall aperture 220, formed in the circular sidewall 60 substantially adjacent to the projection 70. This sidewall aperture 220 is configured for receiving the protruding member 202.

Upon engagement with the sidewall aperture 220, the protruding member 202 obstructs the projection 70 so as to inhibit releasable engagement of the projection 70 from the mounting opening in the tube. And the locking hook 210 and the locking tab 212 insure that the lock member 200 will not become disengaged in transit. And the locking hook 210 and the locking tab 212 cannot be disengaged without damaging these structures. These, combined with the protruding member 202, thus provide three degrees of locking security. So if anyone other the intended recipient attempts to tamper with the shipping container, the damaged lock member elements present evidence of tampering, thereby providing assurance to the recipient that the package has arrived safely, without theft, vandalism or other loss.

A method of operation follows from FIGS. 9 and 10. Prior to the point of use, the lock portion 204 is pivoted into a "pre-loaded" condition as shown in FIG. 9 where the edge 216 brought over a first tab potion 212*a* and is retained between the first tab portion 212*a* and a second tab portion 212*b*. It is retained in this pre-loaded condition until it is "snapped shut" as shown in FIG. 10, where the edge 216 is brought over the second tab portion 212*b*, so that the locking hook 210 is in engagement with the projection aperture 214, whereupon the lock member 200 can lo longer be disengaged. In operation, the tube may be loaded with items to be shipped, and any items can be added or removed. The end cap 50 having a lock member 200 in the pre-loaded condition can be placed on the tube and optionally removed. When the final contents have been added to the tube, the lock portion 204 is snapped shut to as to engage the locking elements, i.e. the locking tab 212 and the locking hook 214.

As shown in FIGS. 1 and 4, in the preferred embodiment, the shipping container tube 10 includes a plurality of mounting openings 40, spaced radially about the cylindrical body 20 adjacent to the open end of the tube. The circular sidewall 60 of the end cap 50 includes a corresponding plurality of projections 70 spaced radially about the circular sidewall 60. In the illustrated embodiments, two or three projections 70 are illustrated as mating with an associated number of mounting openings 40. However, it should be appreciated that four, five or any suitable number can be used, without departing from the present invention.

It should similarly be appreciated that any suitable number of lock members 200 can be provided corresponding to the number of projections 70. For example, in an embodiment including three projections 70, one, two or three lock members 200 may be included. It should also be appreciated that the cylindrical sidewall 60 may be of any height. Applicants have discovered that greater sidewall height adds depth to the end cap 50, and thereby improves stability and securement of the cap 50 to the tube 10, thus further enhancing security. It has also been discovered that a plurality of radially-extending ribs (not shown) formed on the bottom of the end cap 50 contributes structural strength, which thereby enhances the security features of the present invention.

Figure 12:
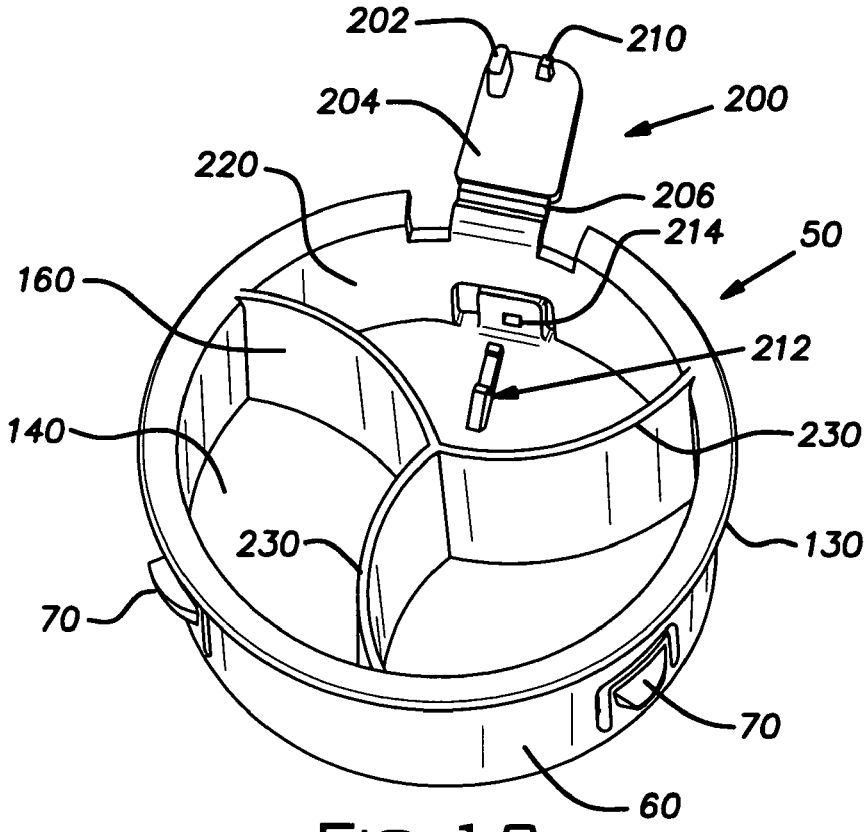
FIG. 12 is a perspective view of an alternate embodiment of an end cap showing an alternative handle design according to the present invention.
Figure 13:
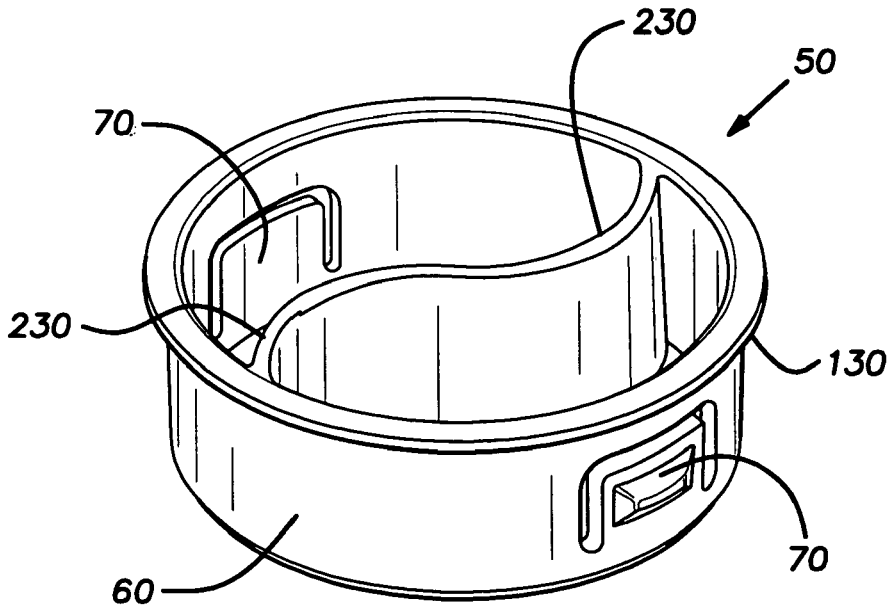
FIG. 13 is a perspective view of a further alternate embodiment of an end cap showing an alternative handle design according to the present invention.

In another aspect of the present invention, as shown in FIGS. 12 and 13, the present end cap 50 includes a handle portion 160 formed of a plurality of arcuate vanes 230. Preferably, the vanes 160 are formed on the end wall 140 that extends between the circular sidewall 60. The plurality of arcuate vanes 230 radiate from a center of the end wall 140 to the circular sidewall 60, and are gripped by a user's hand for facilitating rotation of the end cap 50 relative to the tube. An embodiment is shown in FIG. 12 where the handle portion 160 is formed of three arcuate vanes 230 that meet in the center. An alternate embodiment is shown in FIG. 13 where the handle portion 160 is formed of two arcuate vanes 230 that meet in the center, so as to generally form a single serpentine or "S" shape. The arcuate vanes 230 are found to be easier to mold with the end cap 50 and provide excellent gripping surfaces for installing the end cap 50 to the tube.

Figure 14:
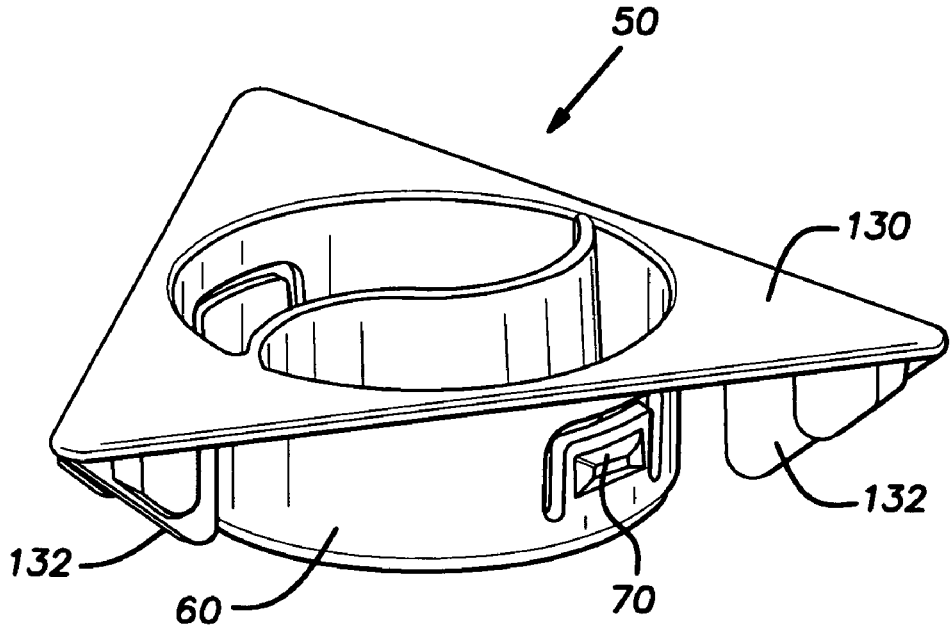
FIG. 14 is a first perspective view of an alternate embodiment of an end cap having a triangular configuration according to the present invention.
Figure 15:
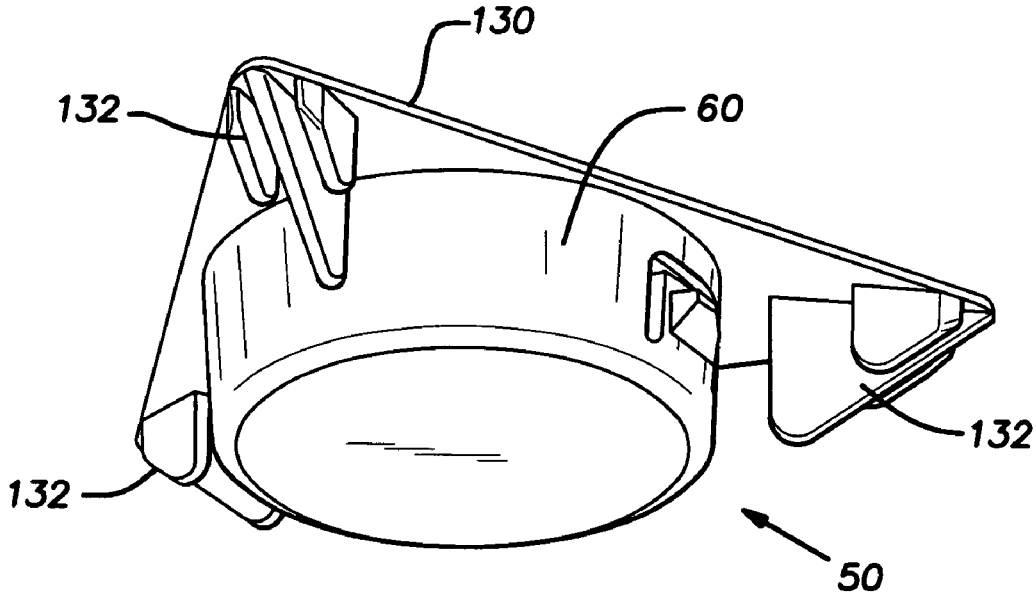
FIG. 15 is a second perspective view of an alternate embodiment of an end cap having a triangular configuration according to the present invention.

The present end cap 50 also preferably includes a peripheral rim portion 130 that extends beyond the circular sidewall 60. The peripheral rim portion 130 contacts a perimeter of the open end of the tube to limit the extent to which the end cap can be inserted into the open end of the tube. In the embodiment of FIGS. 14 and 15, the peripheral rim portion 130 defines a polygonal surface of sufficient size so that the circular sidewall 60 is a circle inscribed within the polygonal surface. It has been observed that cylindrical shipping containers have a tendency to roll. This can be very problematic while on a conveyor belt in a shipping station, e.g. USPS, UPS, FedEx, etc., it such containers can roll off the belt and become damaged or misplaced. The polygonal surface of the peripheral rim portion 130 serves to prevent the shipping container from rolling.

In the preferred embodiment, as shown in the figures, the polygonal surface 130 is substantially triangular. Of course, it should be appreciated that the surface can be rectangular, pentagonal, stellated, or any other suitable shape that would preclude rolling. Also, the polygonal surface 130 also includes reinforcing ribs 132, formed at the corners of the polygonal surface 130. These ribs 132 provide further structural reinforcement and help keep the corners from being damaged during shipping.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed:

1. A shipping container comprising:

a tube comprising a cylindrical body, an open end and a mounting opening formed in the cylindrical body adjacent to the open end; and an end for closing the open end of the tube, the end cap comprising:

a circular sidewall adapted to abut with a portion of the cylindrical body adjacent to the open end of the tube such that the circular sidewall of the end cap is radially surrounded by the cylindrical body of the tube;

a projection extending away from the circular sidewall, the projection being adapted to extend into and releasably engage the mounting opening to secure the end cap to the tube; and a lock member formed integrally with the circular sidewall, wherein the lock member comprises a protruding portion that is adapted to be received within the mounting opening to inhibit disengagement of the projection from the mounting opening.

2. The shipping container according to claim 1 wherein a plurality of mounting openings are spaced radially about the cylindrical body adjacent to the open end and wherein the circular sidewall of the end cap includes a corresponding plurality of projections spaced radially about the circular sidewall.

3. The shipping container according to claim 1 wherein the projection is formed on a deflectable tab portion of the circular sidewall, and wherein the projection further comprises:

a side ramp portion for promoting inward deflection of the deflectable tab portion when the end cap is rotated relative to the tube when the projection is extending into the mounting opening; and wherein the protruding portion of the lock member inhibits disengagement of the projection from the mounting opening when received within the mounting opening by obstructing the side ramp portion so as to prevent inward deflection of the deflectable tab portion when the end cap is rotated relative to the tube.

4. The shipping container according to claim 1 wherein the lock member comprises:

a lock portion, wherein the protruding member extends from a surface of the lock portion;

a sidewall aperture formed in the circular sidewall substantially adjacent to the projection, for receiving the protruding member;

a hinge for pivotally connecting the lock portion to the sidewall of the cap, so as to pivotally swing the protruding portion into engagement with the sidewall aperture;

wherein, upon engagement with the sidewall aperture, the protruding member obstructs the projection, so as to inhibit releasable engagement of the projection from the mounting opening.

5. The shipping container according to claim 4 wherein the lock member further comprises at least one of:

a locking hook for engaging and retaining a projection aperture formed in the projection; and a locking tab, formed on an end wall on the end cap, for engaging and retaining an edge of the locking member.

6. The shipping container according to claim 1 wherein the end cap further comprises a peripheral rim portion that extends beyond the circular sidewall, the peripheral rim portion contacting a perimeter of the open end of the tube to limit the extent to which the end cap can be received within the open end of the tube.

7. The shipping container according to claim 6 wherein the peripheral rim portion defines a polygonal surface such that the circular sidewall is inscribed therein, wherein the polygonal surface serves to prevent the shipping container from rolling.

8. The shipping container according to claim 7 wherein the polygonal surface is substantially triangular and further comprises reinforcing ribs at the corners of the polygonal surface.

9. The shipping container according to claim 1 wherein the end cap further comprises an end wall that extends between the circular sidewall, and wherein the end wall further comprises a handle portion having a plurality of arcuate vanes radiating from a center of the end wall to the circular sidewall for facilitating rotation of the end cap relative to the tube.

10. An end cap for enclosing a tube having a cylindrical body and an open end so as to define a shipping container, wherein the end cap comprises:

a circular sidewall adapted to abut with a portion of the cylindrical body adjacent to the open end of the tube such that the circular sidewall of the end cap is radially surrounded by the cylindrical body of the tube;

a projection extending away from the circular sidewall, the projection being adapted to extend into and releasably engage a mounting opening formed in the tube adjacent to the open end to secure the end cap to the tube; and a lock member formed integrally with the circular sidewall, wherein the lock member comprises a protruding portion that is adapted to be received within the mounting opening to inhibit disengagement of the projection from the mounting opening.

11. The end cap according to claim 10 wherein the circular sidewall of the end cap includes a plurality of projections spaced radially about the circular sidewall.

12. The end cap according to claim 10 wherein the projection is formed on a deflectable tab portion of the circular sidewall, and wherein the projection further comprises:

a side ramp portion for promoting inward deflection of the deflectable tab portion when the end cap is rotated relative to the tube when the projection is extending into the mounting opening; and wherein the protruding portion of the lock member inhibits disengagement of the projection from the mounting opening when received within the mounting opening by obstructing the side ramp portion so as to prevent inward deflection of the deflectable tab portion when the end cap is rotated relative to the tube.

13. The end cap according to claim 10 wherein the lock member comprises:

a lock portion, wherein the protruding member extends from a surface of the lock portion;

a sidewall aperture formed in the circular sidewall substantially adjacent to the projection, for receiving the protruding member;

a hinge for pivotally connecting the lock portion to the sidewall of the cap, so as to pivotally swing the protruding portion into engagement with the sidewall aperture;

wherein, upon engagement with the sidewall aperture, the protruding member obstructs the projection, so as to inhibit releasable engagement of the projection from the mounting opening.

14. The end cap according to claim 13 wherein the lock member further comprises at least one of:

a locking hook for engaging and retaining a projection aperture formed in the projection; and a locking tab, formed on an end wall on the end cap, for engaging and retaining an edge of the locking member.

15. The end cap according to claim 10 wherein the end cap further comprises a peripheral rim portion that extends beyond the circular sidewall, the peripheral rim portion contacting a perimeter of the open end of the tube to limit the extent to which the end cap can be received within the open end of the tube.

16. The end cap according to claim 15 wherein the peripheral rim portion defines a polygonal surface such that the circular sidewall is inscribed therein, wherein the polygonal surface serves to prevent the shipping container from rolling.

17. The end cap according to claim 16 wherein the polygonal surface is substantially triangular and further comprises reinforcing ribs at the corners of the polygonal surface.

18. The end cap according to claim 10 wherein the end cap further comprises an end wall that extends between the circular sidewall, and wherein the end wall further comprises a handle portion having a plurality of arcuate vanes radiating from a center of the end wall to the circular sidewall for facilitating rotation of the end cap relative to the tube.

19. A method of operating a shipping container comprising the steps of:

providing a tube having a cylindrical body and an open end for receiving items to be shipped, wherein the cylindrical body includes a mounting opening formed therein adjacent to the open end;

providing an end cap for enclosing the open end of the tube, the end cap comprising a projection for releasably engaging the mounting opening so as to secure the end cap to the tube, and a lock member comprising a protruding portion selectively displaceable into the mounting opening;

loading the tube with items to be shipped;

enclosing the open end of the tube with the end cap, wherein the step of enclosing comprises engaging the mounting opening with the projection;

actuating the lock member so as to selectively displace the protruding portion into the mounting opening, and thereby inhibit releasable engagement of the projection from the mounting opening.

20. The method of claim 19 wherein the lock member is preloaded.

21. The method of claim 19 wherein the step of actuating the preloaded lock member further comprises engaging a locking element.

22. The method of claim 21 wherein the step of engaging a locking element comprises displacing an edge of a lock portion supporting the protruding portion over a locking tab.

23. The method of claim 21 wherein the step of engaging a locking element comprises bringing a locking hook into engagement with an aperture in the projection, whereupon the lock member can lo longer be disengaged.

24. The method of claim 19 wherein the step of loading the tube further comprises optionally adding and removing items from the tube, and wherein the step of enclosing further comprises removing and enclosing the open end a plurality of times before actuating the preloaded lock member.

* * * * *

UNITED STATES PATENT AND TRADEMARK OFFICE

CERTIFICATE OF CORRECTION

PATENT NO. : 7,581,670 B2
APPLICATION NO. : 11/079739
DATED : September 1, 2009
INVENTOR(S) : Erdie It is certified that error appears in the above-identified patent and that said Letters Patent is hereby corrected as shown below:

In Column 9, Line 44 (Claim 1, Line 5), after "an end", insert --cap--.

Signed and Sealed this

Tenth Day of November, 2009

David J. Kappos

David J. Kappos
*Director of the United States Patent and Trademark Office*